US007418837B2

(12) United States Patent
Müller et al.

(10) Patent No.: US 7,418,837 B2
(45) Date of Patent: Sep. 2, 2008

(54) WARPKNITTED SPACER FABRIC WITH TEARABLE THREADS

(75) Inventors: Frank Müller, Wiehl (DE); Stefan Müller, Wiehl (DE)

(73) Assignee: Muller Textil GmbH, Wiehl-Drabenderhöhe (DE)

( * ) Notice: Subject to any disclaimer, the term of this patent is extended or adjusted under 35 U.S.C. 154(b) by 0 days.

(21) Appl. No.: 11/803,940

(22) Filed: May 16, 2007

(65) Prior Publication Data

US 2008/0072627 A1 Mar. 27, 2008

(30) Foreign Application Priority Data

May 17, 2006 (DE) ..... 10 2006 023 356

(51) Int. Cl.
*D04B 21/00* (2006.01)

(52) U.S. Cl. ..... 66/195; 66/170; 66/196

(58) Field of Classification Search ..... 66/170, 66/169 R, 172 R, 190, 191, 192, 193, 194, 66/195, 196

See application file for complete search history.

(56) References Cited

U.S. PATENT DOCUMENTS

| | | | | | |
|---|---|---|---|---|---|
| 459,866 | A * | 9/1891 | Clewley | 66/170 |
| 592,057 | A * | 10/1897 | Knight | 139/389 |
| 3,470,928 | A * | 10/1969 | Schwartz | 383/117 |
| 3,656,323 | A * | 4/1972 | Brown | 66/177 |
| 4,497,187 | A * | 2/1985 | Yamaguchi | 66/87 |
| 4,787,219 | A * | 11/1988 | Sato et al. | 66/190 |
| 5,385,036 | A * | 1/1995 | Spillane et al. | 66/87 |
| 5,605,731 | A * | 2/1997 | Guasch Pubill | 428/43 |
| 5,791,392 | A * | 8/1998 | Fernandez Lopez | 160/238 |
| 6,105,401 | A * | 8/2000 | Chadeyron et al. | 66/195 |
| 6,199,410 | B1 * | 3/2001 | Rock et al. | 66/195 |
| 6,212,913 | B1 * | 4/2001 | Weiss | 66/172 R |
| 6,308,538 | B1 * | 10/2001 | Wood et al. | 66/170 |
| 6,644,070 | B2 * | 11/2003 | Ikenaga et al. | 66/196 |
| 6,755,052 | B1 * | 6/2004 | Sytz | 66/196 |
| 7,240,522 | B2 * | 7/2007 | Kondou et al. | 66/195 |

FOREIGN PATENT DOCUMENTS

| | | | | |
|---|---|---|---|---|
| DE | 10260694 A1 * | 6/2004 | | 66/195 |

* cited by examiner

*Primary Examiner*—Danny Worrell

(57) ABSTRACT

Warpknitted spacer fabric knitwear 11 consisting of two knitwear layers 12, 13 which are positioned parallel relative to one another and which are connected to one another by pile yarns 14 which extend to and fro, wherein the knitwear layers 12, 13 comprise courses 22, 23 generally extending in the direction of production, as well as weft threads 15, 16 connected by knitting thereto, and wherein the pile yarns 14 extend generally in the direction of production and are connected to the knitwear layers 12, 13, wherein in at least one of the knitwear layers 12, 13 there is worked in at least one weft thread 16 of a lower tear strength for producing a substantially linear nominal separating region T and wherein, in the region of the at least one weft thread 16 of a lower tear strength, at least one pile yarn 14 is left out for additionally weakening the substantially linear nominal separating region T.

24 Claims, 2 Drawing Sheets

WARPKNITTED SPACER FABRIC WITH TEARABLE THREADS

The invention relates to warpknitted spacer fabric consisting of two knitwear layers which are positioned parallel relative to one another and which are connected to one another by pile yarns which extend to and fro, wherein the knitwear layers comprise courses generally extending in the direction of production as well as weft threads connected by knitting thereto and wherein the pile yarns extend generally in the direction of production and are connected to the knitwear layers by knitting. The invention also relates to a cover material produced from a covering layer and a lining produced from warpknitted spacer fabric consisting of two knitwear layers which are positioned parallel relative to one another and which are connected to one another by pile yarns which extend to and fro, wherein the knitwear layers comprise courses generally extending in the direction of production, as well as weft threads connected thereto by knitting and wherein the pile yarns generally extend in the direction of production and are connected to the knitwear layers by knitting.

The pile yarns generally extending in the direction of production, together with the knitwear layers, form connections which can also be referred to as stitch heads. While the individual pile yarns extend to and fro between the knitwear layers, they can, at the same time, extend transversely to and fro in the knitwear layers relative to the direction of production, wherein, if viewed in the direction of production, there is obtained a structure with intersecting pile yarns. This is referred to as X-laying. Alternatively, it is also possible for the pile yarns, when moving to and fro between the knitwear layers, to form substantially linearly arranged connections with the latter, and, if viewed in the direction of production, there is obtained a structure of spacing threads extending parallel relative to one another and at right angles relative to the knitwear layers. This is referred to as I-laying.

Warpknitted spacer fabric of said type are to a large extent produced from thermoplastic plastics, with the two knitwear layers mostly consisting of multi-filaments and pile yarns of monofilaments. The knitwear is produced in the form of continuous lengths of material whose width is determined by the production width of the machine used or by the intended application. For product producing purposes, the material is separated by circular blades or by punches. More particularly, prior to rolling up the material lengths, the unusable edge regions are separated thermally. Independently of the above-mentioned preferred type of thread consisting of thermoplastic plastics, the invention, without any restrictions, also refers to warpknitted spacer fabric made of a thread material consisting of thermoplastically stable threads.

The cover materials of the above-mentioned type which are lined with warpknitted spacer fabric are frequently used in the automotive industry for vehicle seats, more particularly also as cover materials for dashboards and other interior linings. The cover material of said type is produced by laminating on to same material lengths of the warpknitted spacer fabric, so that the starting material, too, is initially available in the form of material lengths. The required shapes or cuts are produced out of the material lengths by being cut by punching blades or by laser.

From DE 102 60 694 A1, there is known a composite material consisting of strip-shaped three-dimensional spaced knitwear wherein the individual longitudinal strips are produced with strong longitudinal edges and they are separatably connected by deviatingly worked-in separating threads between the knitwear layers. The respective production process serves to produce a plurality of elastic bandages in one common operating process which are separated in a subsequent separating operation. A homogenous behaviour of the intermediate product cannot be expected.

It is the object of the present invention to provide products of said type which permit the material to be separated easily along predetermined separating lines, with the material also being suitable for being used prior to being separated.

The objective is achieved by providing warpknitted spacer fabric consisting of two knitwear layers which are positioned parallel relative to one another and which are connected to one another by pile yarns which extend to and fro, wherein the knitwear layers comprise courses generally extending in the direction of production, as well as weft threads connected by knitting thereto, and wherein the pile yarns extend generally in the direction of production and are connected to the knitwear layers, wherein in at least one of the knitwear layers there is worked in at least one weft thread of a lower tear strength for producing a substantially linear nominal separating region T and wherein, in the region of the at least one weft thread of a lower tear strength, at least one pile yarns is left out for additionally weakening the substantially linear nominal separating region.

However, according to a preferred embodiment, it is proposed that in both knitwear layers arranged in positions corresponding to one another transversely to the direction of production, there is worked-in at least one weft thread of a lower tear strength for producing a substantially linear nominal separating region.

Particularly advantageous homogeneous properties regarding a uniform upsetting hardness prior to the separating operation are achieved in that, in the longitudinal direction, next to the area where at least one pile yarn has been left out, there is worked-in at least one additional pile yarn laid in a way which deviates from the above-mentioned spacing threads and comprises a higher density of connections with the knitwear layers.

More particularly, it is proposed that the pile yarn mentioned first, in the direction of production P, extend transversely to and fro in the knitwear layers and that the at least one additional pile yarn, in the direction of production P, forms linearly arranged connections in the knitwear layers (I-laying).

In this way, the defective regions at connecting points (stitch heads) occurring due to a pile yarn being left out in the area of the separating regions are replaced by additional and more densely arranged connecting points (stitch heads) positioned next to the separating region; if two additional pile yarns are used on either side of the separating region, they are arranged approximately linearly along and next to same. As the additional pile yarns feature I-laying, there is achieved a locally higher upsetting hardness which, however, with reference to a larger overall surface area, is to ensure a homogeneous upsetting hardness of the warpknitted spacer fabric and a homogenous surface structure of the knitwear layers.

The at least one additional pile yarn or the two additional pile yarns require an additional laying rail during the production process in order to achieve the deviating type of laying relative to the remaining pile yarns mentioned first.

For the weft threads of a lower tear strength (tearable threads) it is preferred to use thin mono-filaments, for example consisting of polyester, with a thickness of less than 50 dTex, more particularly less than 30 dTex, whereas the weft threads of a greater tear strength (resistance threads) should be used in the form of multi-filaments, e.g. also consisting of polyester, with a thickness in excess of 45 dTex, more particularly in excess of 70 dTex.

The above-mentioned inventive measures ensure that if the material is subjected to loads in the material plane with a load percentage transversely to the direction of production or if the material is loaded by shear forces on both sides of the prepared separating line perpendicularly to the material plane, the material tears along the separating line while the weft threads of a lower tearing strength are destroyed, and is separated as pre-determined along a line.

As specified, this can serve a first purpose which consists in separating—prior to using the spacing knitwear—the longitudinal edges of the spaced knitwear which occur during production, extend in the direction of production and which, furthermore have a shape and quality which deviate from the remaining spaced knitwear. Said separating process can be effected by mechanical forces and does not require any thermal separating devices, as used to be the case, or circular blades. To the extent that said application is aimed at, the separating regions have to be provided as closely as possible along the side edges.

For example, this is advantageous for those kinds of spaced knitwear which are to be used in mattresses or as resting mats. Such spaced knitwear has a relatively great thickness and, to achieve higher returning forces under pressure loads, comprise relatively stable monofilaments as pile yarns. If said pile yarns are separated thermally or mechanically, there occur broken pieces with free thread ends which can stick out of the spaced knitwear or have a comfort-reducing effect in their final application. The occurrence of broken pieces of pile yarns is avoided by the present invention.

According to a second purpose of application, it is proposed to use a knitting machine set to a maximum production width, although there is only a need for knitwear material whose width is only a percentage of the production width. It is possible, in one production operation, to produce two or more initially connected material strips which extend in the direction of production and which, subsequently, are separated by mechanical forces; for this purpose, it is possible to use shear forces in that the individual material strips are guided at different levels and are wound up on shafts with different axial positions.

A third application consists in providing in the length of material a nominal separating region which is only used in a piece cut out of the length of material for a specified application, more particularly when the spaced knitwear is overloaded and if the type of failure or separation has to be controlled.

Similarly to the previously mentioned applications, an inventive cover material can serve a purpose wherein any edges which are useless and which occurred during production are separated from the cover material.

In addition, the purpose can be that when making use of large machine widths, there are produced several cover material strips which subsequently have to be separated from one another and which comprise only half or a different percentage of the available production width.

A third and important purpose consists in producing a cover material which, when overloaded in use, is destroyed or torn in a controlled way in a predetermined controlled separating region.

More particularly, such an application can consist in using the cover material for covering a motor vehicle dashboard underneath which there is fitted an airbag for ensuring the safety of the passenger or in using it for covering the steering wheel of a motor vehicle, with an airbag being fitted in the steering wheel plate or the deflector plate. When the airbag built in under said cover material is explosively released, the function of same should not be obstructed and the cover material whose outside does not indicate a separating region is to be easily tearable along a predetermined separating region.

Two preferred embodiments of the invention are illustrated in the drawings and will be described below.

FIG. 1 shows a rectangular piece cut out of an inventive piece of spaced knitwear wherein the delimiting edges as illustrated are to be interpreted symbolically only because, in reality, a piece of knitwear does consist of courses and weft threads in the knitwear layers and of spacing threads between the knitwear layers not extending in straight lines.

Figure 1:
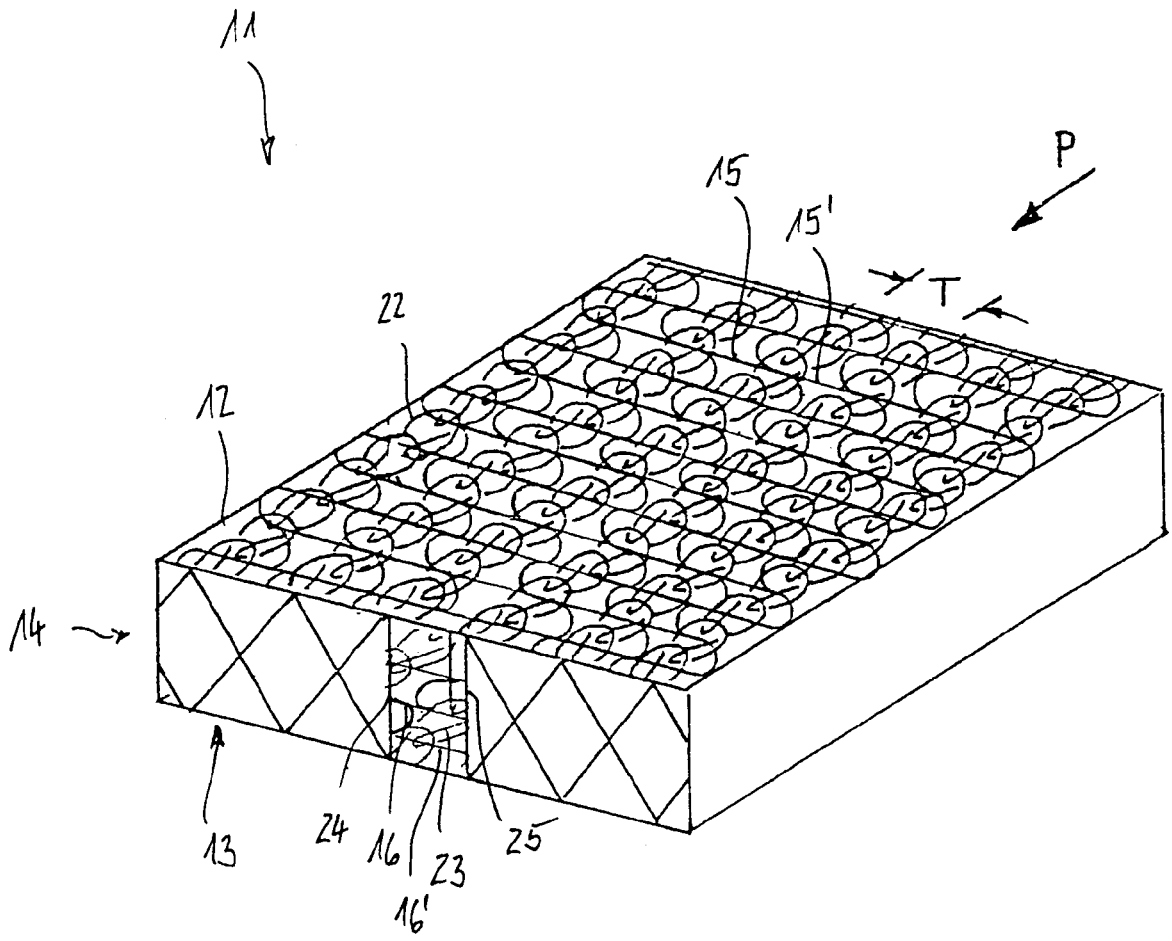
FIG. 1 shows part of an inventive piece of spaced knitwear in an isometric illustration.

There is shown an upper knitwear layer 12, a lower knitwear layer 13 as well as intermediate pile yarns 14, with the arrow P indicating the direction of production of the spaced knitwear. The two knitwear layers consist of courses 22, 23 which extend in the direction of production and comprise warp threads and weft threads 15, 16 connected thereto by knitting. It should be understood that the entire upper knitwear layer 12 and the entire lower knitwear layer 13 consist entirely of substantially uniformly extending courses and weft threads 15, 16 uniformly knitted to one another. The pile yarns 14 or pole threads are symbolically illustrated at the front transverse edge only, but not at the front side edge extending in the direction of production. The pile yarns 14 substantially extend in the direction of production P and extend regularly to and fro between the knitwear layers 12, 13 into which they are knitted. Every pile yarn 14 extends to and fro transversely to the direction of production, which is indicated by a cross structure of the lines. This type of laying is referred to as X-laying. In accordance with the invention, the weft threads 15, 16 comprise first weft threads of a greater tear strength which are symbolized by thicker lines and second weft threads 15', 16' which are positioned in a separating region of a width T and which are symbolized by thinner lines. In the region of the weft threads 15 of the upper knitwear layer 12 and 16 in the lower knitwear layer 13, in a separating region of width T, pile yarns 14 are left out on both sides of the separating region of width T, but there are provided additional pile yarns 24, 25 which also extend substantially in the direction of production P while moving to and fro between the knitwear layers 12, 13 without moving to and fro transversely to the direction of production, which is indicated by lines drawn perpendicularly to the direction of production. This type of laying is referred to as I-laying. The weft threads 15', 16' of a lower tear strength can be marked by a colour which deviates from the colour of the weft threads with a higher tear strength. The different tear strengths of the weft threads can be indicated by different thread thicknesses or different numbers of filaments or, if the thread thickness is the same, by a different quality. It is understandable that if a load is applied perpendicularly to the direction of production or if a load is applied by shear forces perpendicularly to the planes of the knitwear layers 12, 13, the spaced knitwear 11 will fail along the separating region of the width T, with at least one weft thread 15', 16' each of a lower tear strength being torn. This is the objective and purpose of the subject of the invention.

Figure 2:
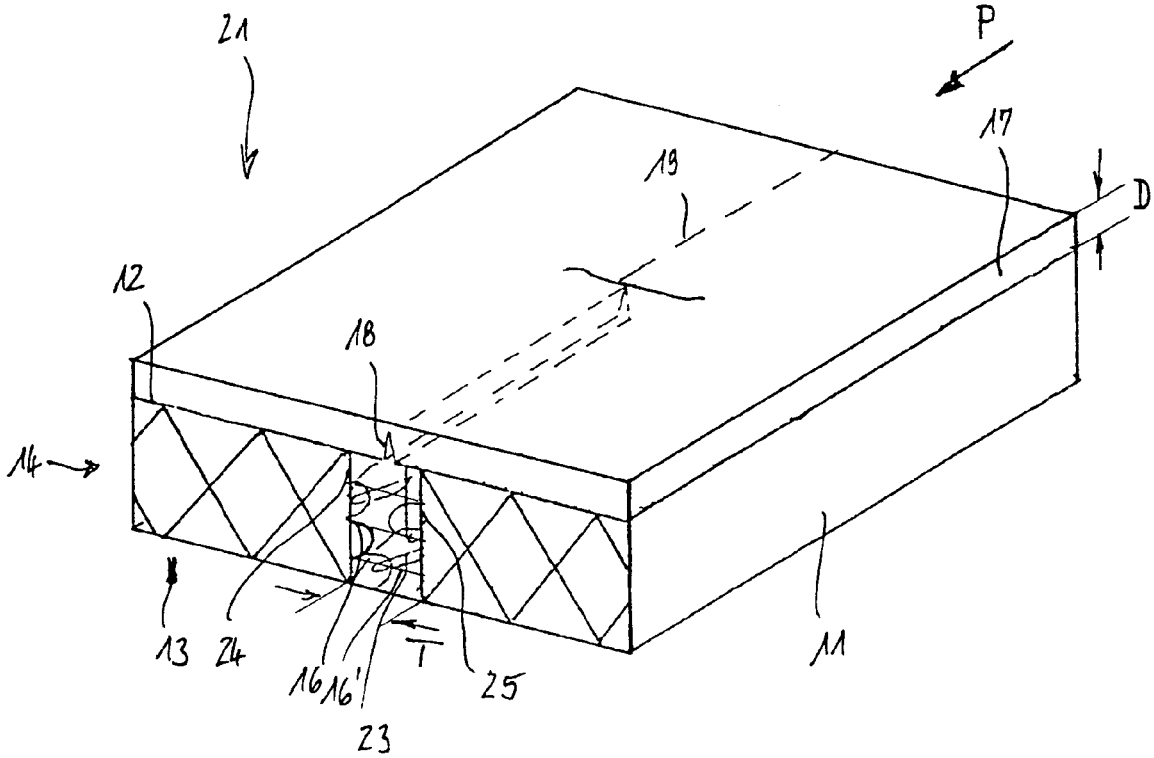
FIG. 2 shows part of an inventive piece of warpknitted spacer fabric or spaced knitwear with the cover material being laminated to same, in an isometric illustration.

FIG. 2 shows a cover material 21 made of spaced knitwear according to FIG. 1, with the same reference numbers being used, on to which there is laminated a covering layer 17 of a substantially homogenous material quality. The glue used in this case is not illustrated in detail. The direction of production is again indicated by an arrow P. The laminated-on covering layer 17 covers the upper knitwear layer 12; of the lower knitwear layer 13, there are shown the courses 23 and also the weft threads 16' of a lower tear strength in the region of the width T. To one side thereof there are indicated weft threads 16 of a greater tear strength. The structure of the upper knitwear layer 12 is to correspond entirely to that shown in FIG. 1. The covering layer 17 comprises an inner, longitudinally extending scratch 18 which extends over the front half of the material portion and which comprises only part of the thickness of the covering layer 17. To that extent, the outer side of the covering material does not show the scratch. In the rear half of the material portion, the covering layer 17 comprises a perforated line 19 which extends through the entire thickness D of the covering layer 17 and, to that extent, is visible from the outside at the covering material. It is understood that the spaced knitwear 11 with a laminated-on covering layer 17, when subjected to tensile loads in the material plane, is destroyed perpendicularly to the direction of production or, when subjected to shear forces, is destroyed perpendicularly to the plane of the knitwear layers 12, 13 in the area of the separating region of width T, with the covering layer 17 tearing apart along the scratching or the perforation. This is the objective and purpose of the subject of the invention.

LIST OF REFERENCE NUMBERS

11 Warpknitted spacer fabric (spaced knitwear)
12 upper knitwear layer
13 lower knitwear layer
14 pile yarns
15 weft threads (upper knitwear layer)
16 weft threads (lower knitwear layer)
17 covering layer
18 scratch
19 perforation
20 -
21 cover material
22 course (upper knitwear layer)
23 course (lower knitwear layer
24 pile yarns
25 pile yarns
T separating region
D thickness of covering layer

The invention claimed is:

1. A warpknitted spacer fabric (11) comprising two knitwear layers (12, 13) which are positioned parallel relative to one another, and a plurality of pile yarns (14) connecting the two knitwear layers (12, 13), wherein the pile yarns (14) which extend to and fro, wherein the two knitwear layers (12, 13) comprise courses (22, 23) generally extending in a direction of production, and weft threads (15, 16) connected by knitting to the two knitwear layers (12, 13), wherein the pile yarns (14) extend generally in the direction of production and are connected to the two knitwear layers (12, 13), wherein at least one of the two knitwear layers (12, 13) further comprises at least one weft thread ($\mathbf{15}^1$, $\mathbf{16}^1$), the at least one weft thread ($\mathbf{15}^1$, $\mathbf{16}^1$) having a lower tear strength then the other weft threads (15, 16) and being worked in, thereby producing a substantially linear nominal separating region (T) and wherein, in the linear nominal separating region (T), at least one of the pile yarns (14) is left out, thereby providing a weakening of the substantially linear nominal separating region (T).

2. A warpknitted spacer fabric according to claim 1, wherein in both knitwear layers (12, 13) arranged in positions corresponding to one another, there is worked in at least one weft thread (15', 16') of a lower tear strength thereby producing the substantially linear nominal separating region (T).

3. A warpknitted spacer fabric according to claim 1, wherein, in the longitudinal direction, next to the area where at least one pile yarn (14) has been left out, there is worked in at least one additional pile yarn (24, 25) laid in a way which deviates from the above-mentioned pile yams (14).

4. A warpknitted spacer fabric according to claim 3, wherein the pile yarns (14) mentioned first, in the direction of production P, extend transversely to and fro in the knitwear layers (12, 13) and that the at least one additional pile yarn (24, 25), in the direction of production P, forms linearly arranged connections in the knitwear layers (12, 13).

5. A warpknitted spacer fabric according to claim 1, wherein the at least one weft thread (15', 16') of a lower tear strength is marked by a colour which deviates from that of the remaining weft threads (15, 16).

6. A warpknitted spacer fabric according to claim 1, wherein the weft threads (15, 16) of a higher tear strength which directly adjoin the at least one weft thread (15', 16') of a lower tear strength are marked by a colour which deviates from that of the remaining weft threads.

7. A warpknitted spacer fabric according to claim 1, wherein the weft threads (15', 16') of a lower tear strength are formed by a monofilament with a thickness smaller than 50 dTex, more particularly smaller than 30 dTex.

8. A warpknitted spacer fabric according to claim 1, wherein the weft threads (15, 16) of a greater tear strength are formed by multi-filaments with a thickness greater than 45 dTex, more particularly greater than 70 dTex.

9. A warpknitted spacer fabric according to claim 1, wherein a nominal separating region (T) is provided near the lateral edges extending in the direction of production P for separating the production edges.

10. A warpknitted spacer fabric according to claim 1, further comprising a plurality of identically spaced nominal separating regions (T) thereby producing out of the spaced knitwear, individual strips extending in the direction of production P and having a predetermined width.

11. A cover material produced from a covering layer (17) and a lining produced from warpknitted spacer fabric (11), comprising two knitwear layers (12, 13) which are positioned parallel relative to one another, and a plurality of pile yarns (14) connecting the two knitwear layers (12, 13), wherein the pile yarns extend to and fro, wherein the two knitwear layers (12, 13) comprise courses (22, 23) generally extending in a direction of production, and weft threads (15, 16) connected by knitting to the two knitwear layers (12, 13), wherein the pile yarns (14) extend generally in the direction of production and are connected to the two knitwear layers (12, 13), wherein at least one of the two knitwear layers (12, 13) further comprises at least one weft thread (15', 16'), the at least one weft thread (15', 16') having a lower tear strength than the other weft threads (15, 16), and being worked in, thereby producing a substantially linear nominal separating region (T) and wherein, in the lower tear region (T), at least one of the plurality of pile yarns (14) is left out, thereby providing an additional weakening of the substantially linear nominal separating region (T).

12. A cover material according to claim 11, wherein both of the two knitwear layers (12, 13) comprise at least one weft thread (15', 16'), and wherein the at least one weft thread (15', 16') has a lower tear strength. thereby producing the substantially linear nominal separating region (T).

13. A cover material according to claim 11, wherein, in the longitudinal direction, next to the area where at least one pile yam (14) has been left out, there is worked-in at least one additional pile yarn (24, 25) laid in a way which deviates from the above-mentioned pile yarns (14).

14. A cover material according to claim 13, wherein the pile yarns (14) mentioned first, in the direction of production P, extend transversely to and fro in the knitwear layers (12, 13) and that the at least one additional pile yarn (24, 25), in the direction of production P, forms linearly arranged connections in the knitwear layers (12, 13).

15. A cover material according to claim 11, wherein the covering layer (17), in the region of the nominal separating region (T), comprises a weakened region of material whose extension corresponds to that of the nominal separating region (T).

16. A cover material according to claim 11, wherein the covering layer (17) comprises is a substantially homogenous material selected from the group of leather and plastic foil.

17. A cover material according to claim 11, wherein the weakened region of the covering layer (17) comprises an inner scratched line (18).

18. A cover material according to claim 11, wherein the covering layer (17) is laminated onto the warpknitted spacer fabric (11).

19. A cover material according to claim 11, wherein the at least one weft thread (15', 16') of a lower tear strength is marked by a colour which deviates from that of the remaining weft threads (15, 16).

20. A cover material according to claim 11, wherein the weft threads (15, 16) of a higher tear strength which directly adjoin the at least one weft thread (15', 16') of a lower tear strength are marked by a colour which deviates from that of the remaining weft threads.

21. A cover material according to claim 11, wherein the weft threads (15', 16') of a lower tear strength are formed by a monofilament with a thickness of less than 50 dTex, more particularly less than 30 dTex.

22. A cover material according to claim 11, wherein the weft threads (15, 16) of a greater tear strength are formed by multi-filaments with a thickness greater than 50 dTex, more particularly greater than 75 dTex.

23. A cover material according to claim 11, further comprising a nominal separating region (T) provided near lateral edge regions extending in the direction of production P, whereby production edges are separated.

24. A cover material according to claim 11, further comprising a plurality of identically spaced nominal separating regions (T) thereby producing individual strips extending in the direction of production P, the individual strips having a predetermined width.

* * * * *